US011581111B2

(12) United States Patent
Pusthay et al.

(10) Patent No.: US 11,581,111 B2
(45) Date of Patent: Feb. 14, 2023

(54) COMPOSITE POLYMER INSULATORS AND METHODS FOR FORMING SAME

(71) Applicant: TE Connectivity Solutions GmbH, Schaffhausen (CH)

(72) Inventors: Kiran Pusthay, Cary, NC (US); Senthil Asok Kumar, Morrisville, NC (US)

(73) Assignee: TE CONNECTIVITY SOLUTIONS GMBH, Schaffhausen (CH)

( * ) Notice: Subject to any disclaimer, the term of this patent is extended or adjusted under 35 U.S.C. 154(b) by 56 days.

(21) Appl. No.: 16/998,760

(22) Filed: Aug. 20, 2020

(65) Prior Publication Data

US 2022/0059258 A1 Feb. 24, 2022

(51) Int. Cl.
*H01B 17/60* (2006.01)
*H01B 3/47* (2006.01)
*H01B 19/00* (2006.01)

(52) U.S. Cl.
CPC ..... *H01B 17/60* (2013.01); *H01B 3/47* (2013.01); *H01B 19/00* (2013.01)

(58) Field of Classification Search
CPC ..... H01B 17/60
USPC ..... 174/209
See application file for complete search history.

(56) References Cited

U.S. PATENT DOCUMENTS 5,540,991 A * 7/1996 Hayakawa ..... B29C 33/123 174/174
6,105,248 A 8/2000 Tani
6,225,567 B1 * 5/2001 Kester ..... H01T 4/04 174/178
6,307,157 B1 10/2001 Fujii et al.
6,844,503 B2 1/2005 Thornley et al.
7,180,003 B2 2/2007 Almgren et al.
8,653,376 B2 2/2014 Birrer et al.
9,312,053 B2 4/2016 Hinrichsen et al.
9,970,976 B2 5/2018 Coulloudon et al.
2002/0158745 A1 * 10/2002 Haynam ..... H01H 31/023 337/171
2014/0054063 A1 2/2014 George et al.
2015/0136470 A1 5/2015 Jia et al.
2019/0168489 A1 * 6/2019 Benkert ..... C04B 37/00

OTHER PUBLICATIONS

Electronics Raychem, TE Connectivity Silicon, 2011, Ireland (Year: 2011).*
TE Connectivity Silicone Suspension / Tension Insulators 70kN up to LIWV 450kV (BIL) product sheet, Tyco Electronics Raychem Ireland Ltd. (8 pages) (2011).

* cited by examiner

*Primary Examiner* — Stanley Tso

(57) ABSTRACT

Embodiments of the invention are directed to a method for manufacturing a composite polymer insulator. The method includes: providing an elongate core having a core axis, the core including a first core main section, a second core main section, and a core midsection axially interposed between the first and second core main sections; and mounting a joint sleeve around the core midsection. The method further includes molding a polymeric first housing onto the core such that: the first housing surrounds the first core main section; and a joint section the first housing overlaps and bonds to the joint sleeve. The method further includes molding a polymeric second housing onto the core such that: the second housing surrounds the second core main section; and a joint section of the second housing overlaps and bonds to the joint sleeve.

22 Claims, 12 Drawing Sheets

COMPOSITE POLYMER INSULATORS AND METHODS FOR FORMING SAME

FIELD OF THE INVENTION

The present invention relates to electrical insulators and, more particularly, to composite polymer insulators and methods for forming the same.

BACKGROUND OF THE INVENTION

Composite polymer insulators are used to support electrical power conductors and to secure electrical power conductors to support structures. In particular, composite polymer insulators are commonly used to support and attach high voltage (HV) power lines. As used herein, "high voltage" means a power line operating at a voltage of 69 kilovolts (kV) or greater.

Composite polymer insulators typically include an elongate, electrically insulating core, an electrically insulating housing surrounding the core, and end fittings affixed to the ends of the core. The core provides mechanical strength. The housing may include radially outwardly projecting sheds. The end fittings may be formed of metal (e.g., steel) and are configured to couple the ends of the insulator to cables and/or supports. The core may be formed of fiberglass composite material (e.g., fiberglass reinforced resin). The housing may be formed of an elastomeric material (e.g., silicone rubber). The housing may be mounted on the core by molding (e.g., injection molding) or by inserting the core into a preformed housing.

Current manufacturing techniques for producing long polymer insulators require molds that are bulky and expensive. Additionally, during the molding process, sometimes the insulators are molded in multiple sections such that each section has an overlapping or underlapping polymer surface. This overlapped section is susceptible to damage due to electrical activity and tears.

SUMMARY OF THE INVENTION

As a first aspect, embodiments of the invention are directed to a method for manufacturing a composite polymer insulator. The method includes: providing an elongate core having a core axis, the core including a first core main section, a second core main section, and a core midsection axially interposed between the first and second core main sections; and mounting a joint sleeve around the core midsection. The method further includes molding a polymeric first housing onto the core such that: the first housing surrounds the first core main section; and a joint section the first housing overlaps and bonds to the joint sleeve. The method further includes molding a polymeric second housing onto the core such that: the second housing surrounds the second core main section; and a joint section of the second housing overlaps and bonds to the joint sleeve.

As a second aspect, embodiments of the invention are directed to a composite polymer insulator including an elongate core, a polymeric first housing, a polymeric second housing, and a joint sleeve. The core has a core axis. The core includes a first core main section, a second core main section, and a core midsection axially interposed between the first and second core main sections. The first housing surrounds the first core main section. The second housing surrounds the second core main section. The joint sleeve surrounds the core midsection. The first housing includes a joint section overlapping and bonded to the joint sleeve. The second housing includes a joint section overlapping and bonded to the joint sleeve.

DETAILED DESCRIPTION OF THE DRAWINGS

Figure 1:
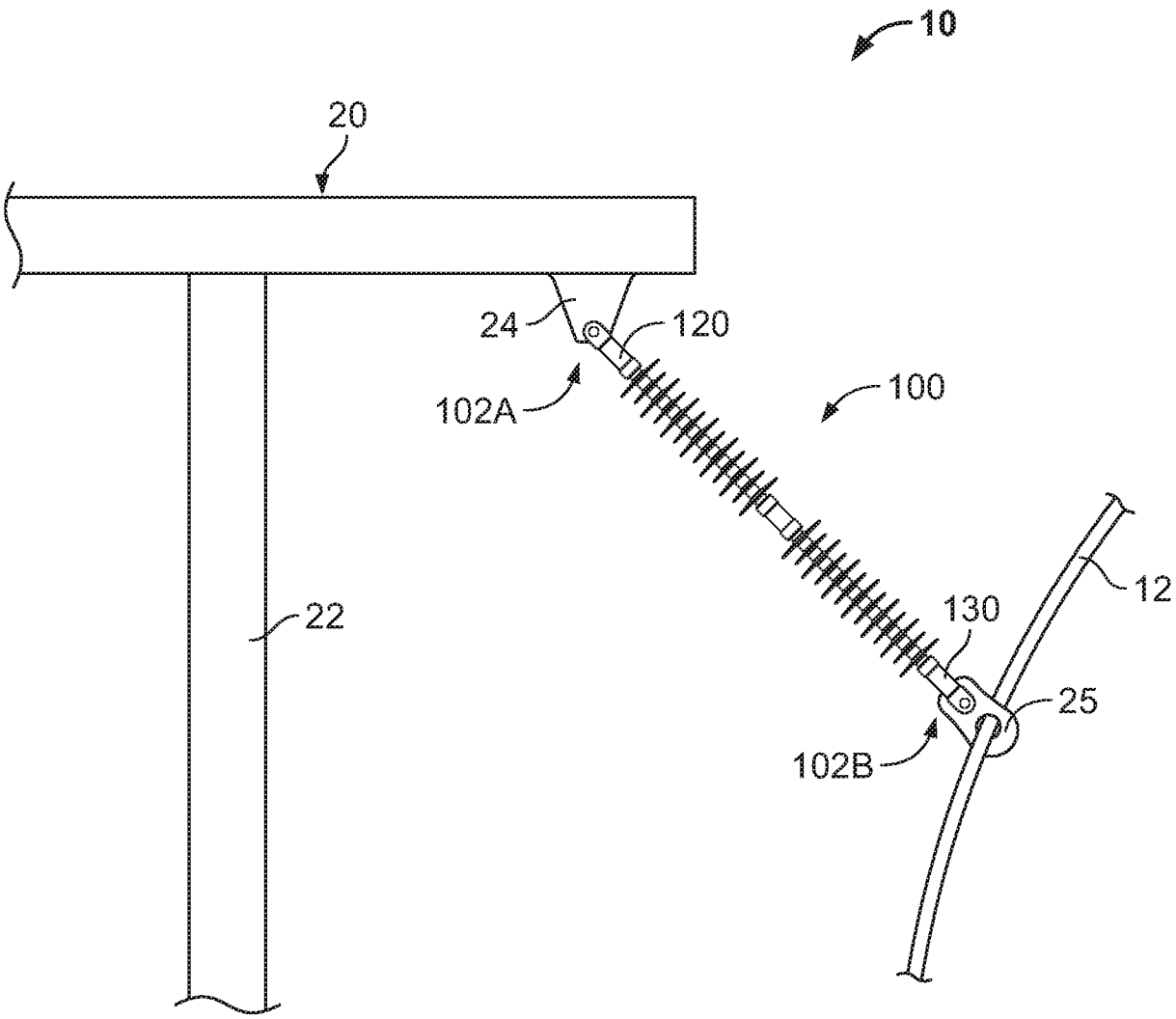
FIG. 1 is a fragmentary view of an electrical power distribution system including a composite polymer insulator according to some embodiments.
Figure 2:
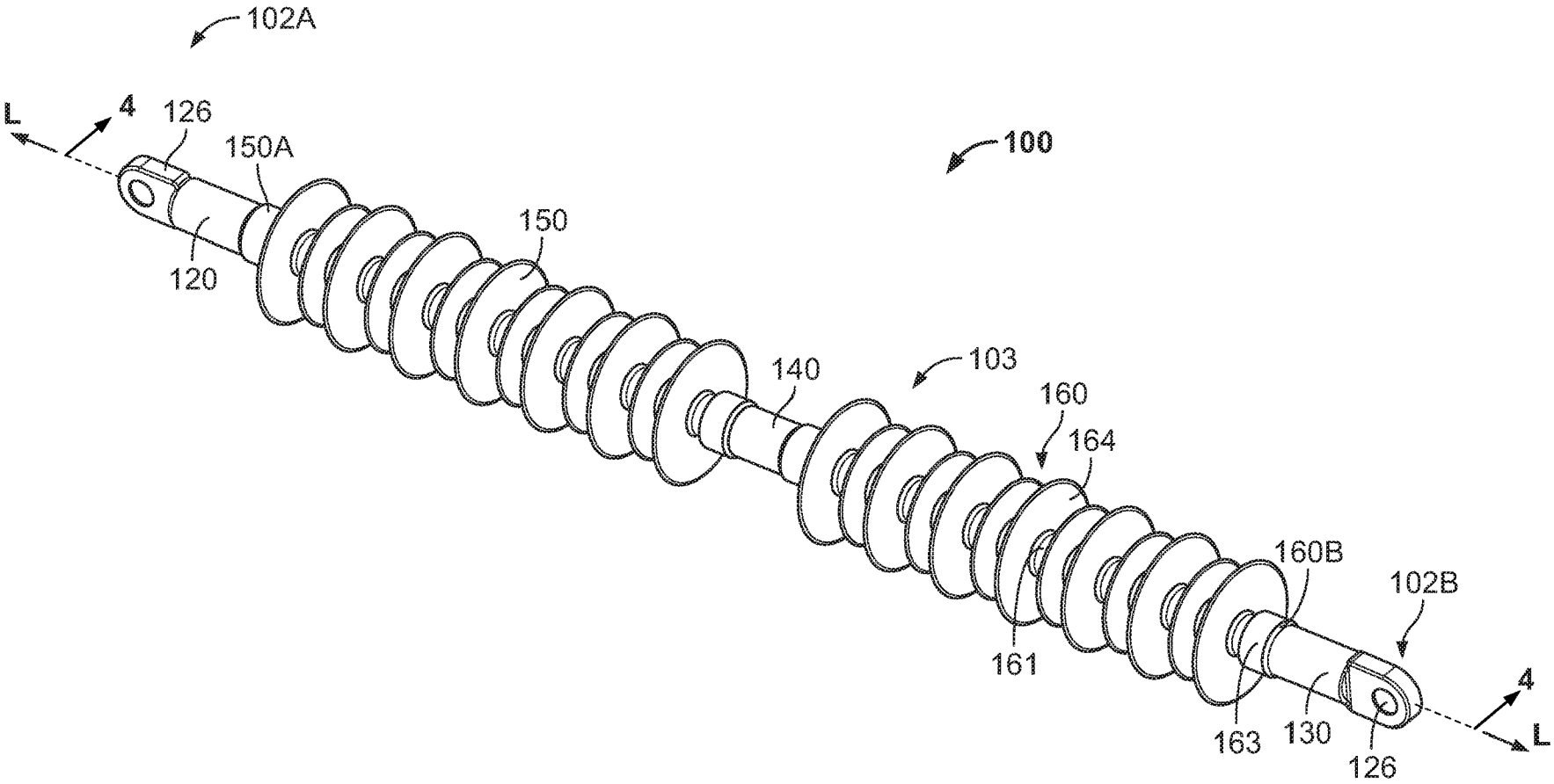
FIG. 2 is a perspective view of the insulator of FIG. 1.
Figure 3:
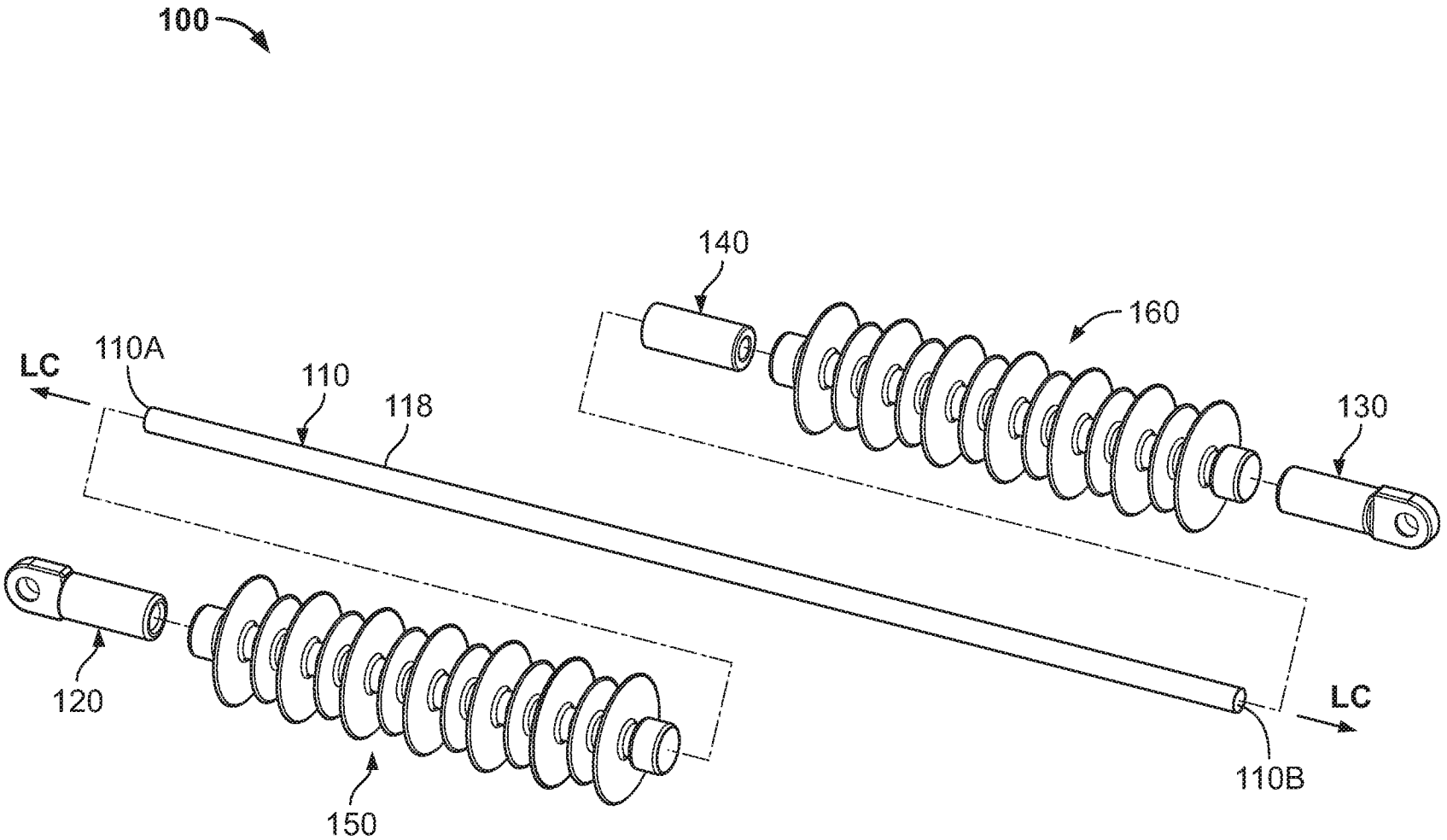
FIG. 3 is an exploded, perspective view of the insulator of FIG. 1.
Figure 4:
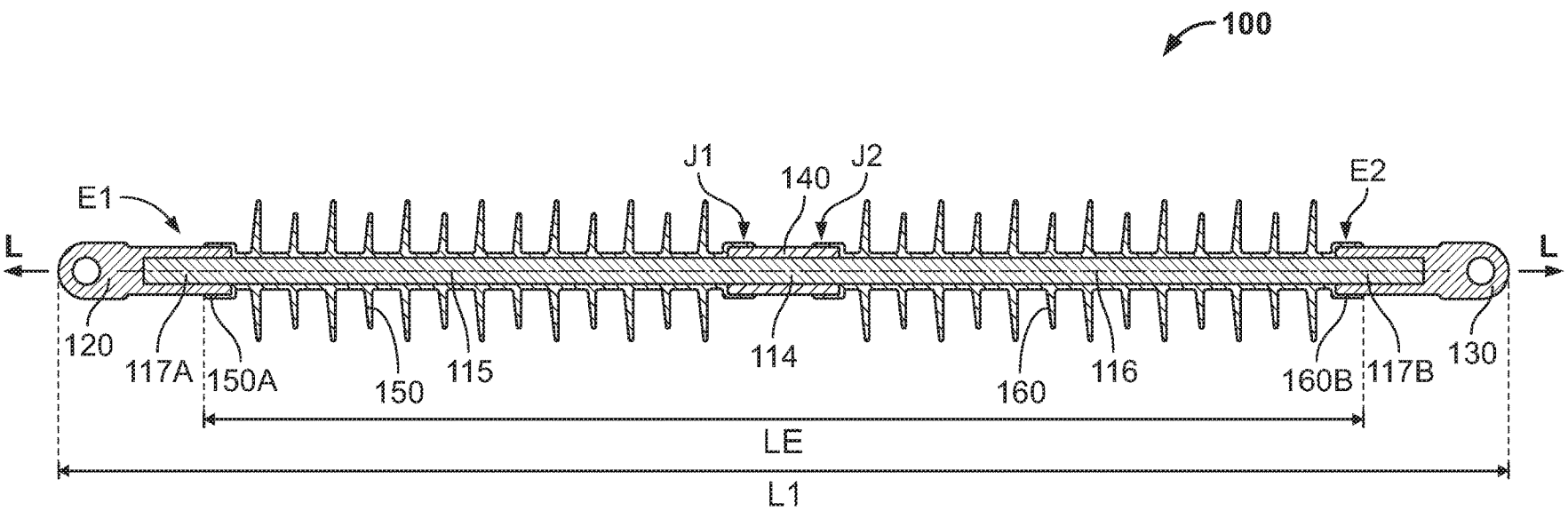
FIG. 4 is a cross-sectional view of the insulator of FIG. 1 taken along the line 4-4 of FIG. 2.
Figure 5:
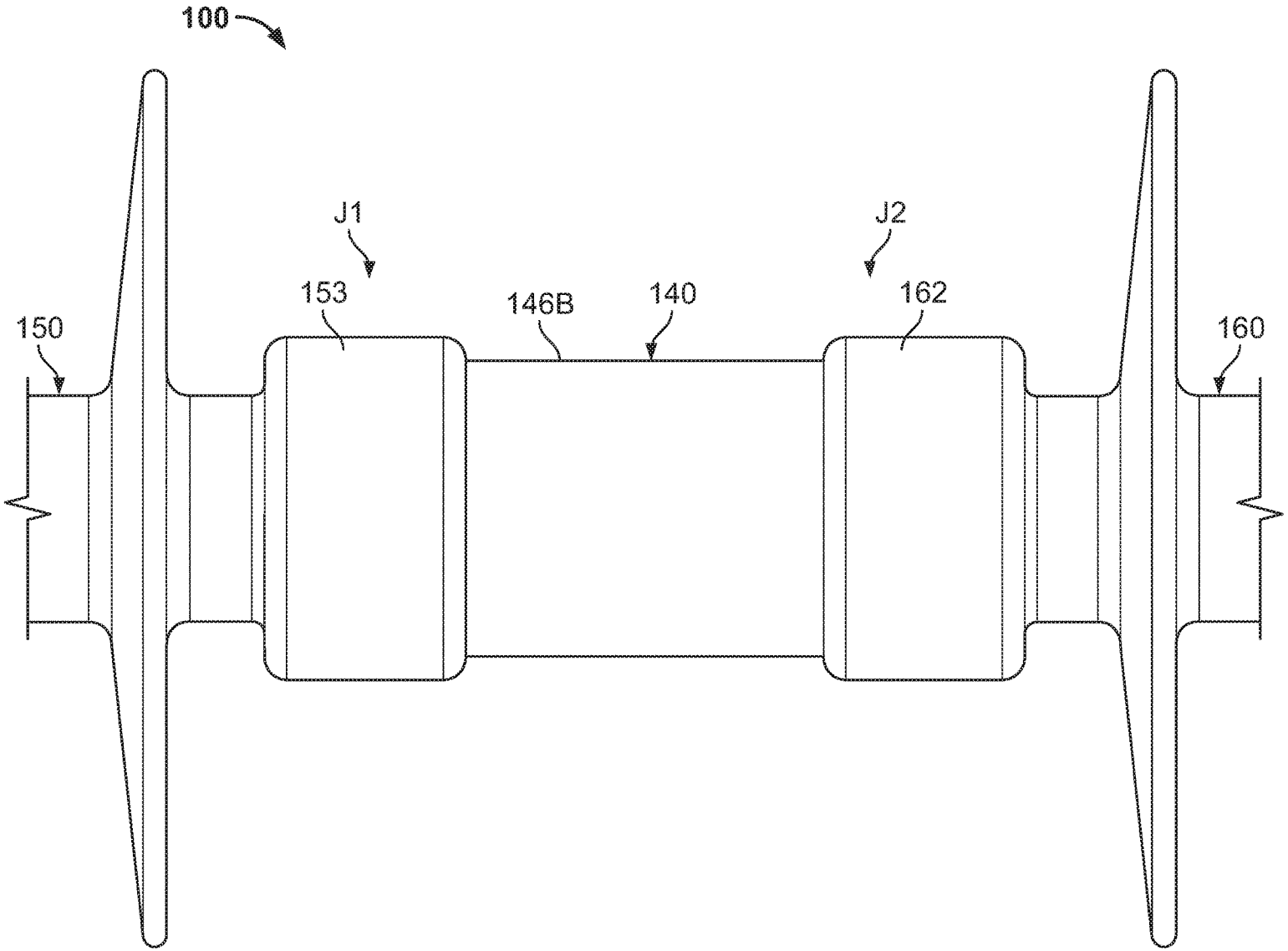
FIG. 5 is an enlarged, fragmentary side view of the insulator of FIG. 1.
Figure 6:
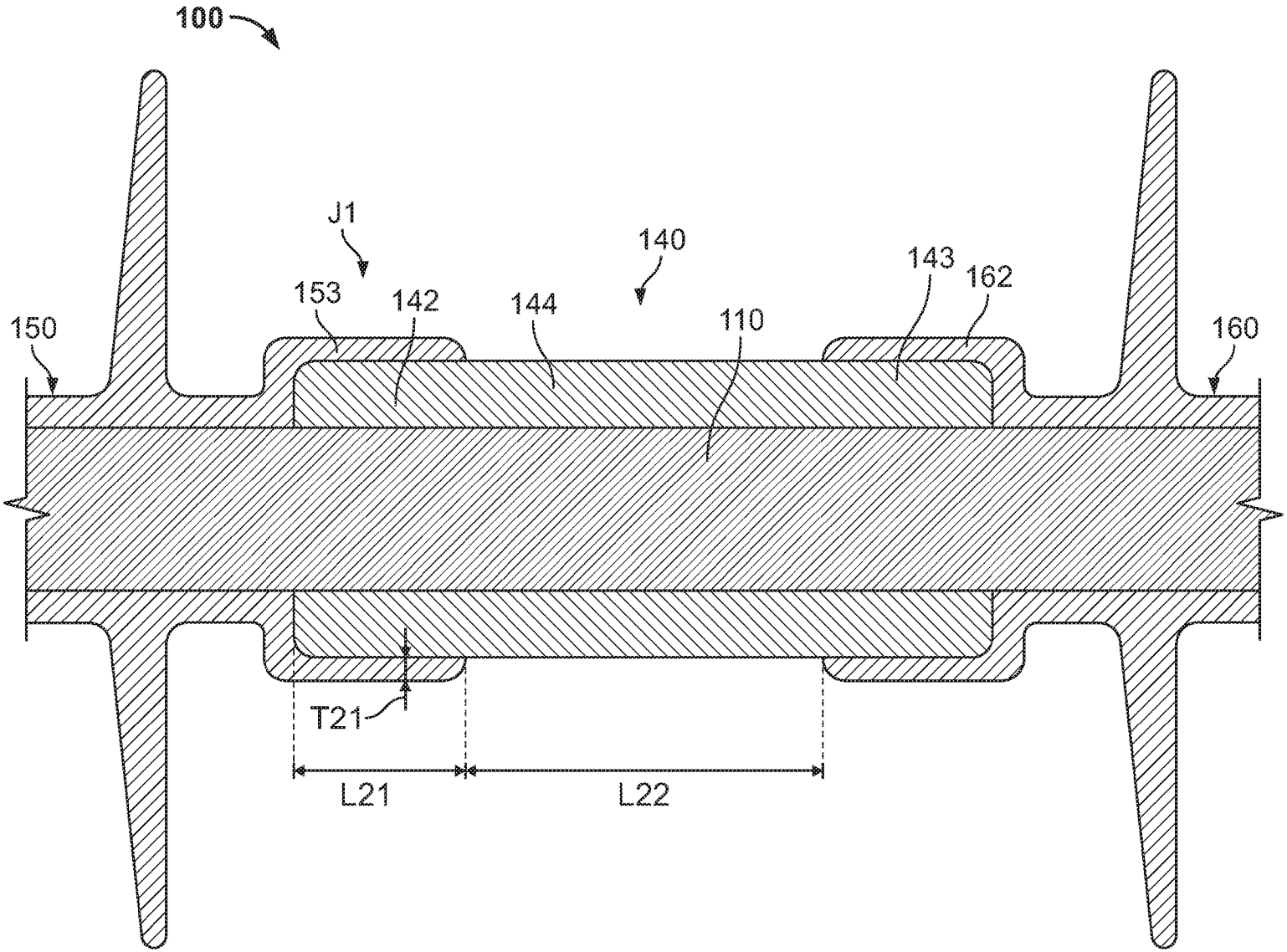
FIG. 6 is an enlarged, fragmentary, cross-sectional view of the insulator of FIG. 1 taken along the line 4-4 of FIG. 2.
Figure 7:
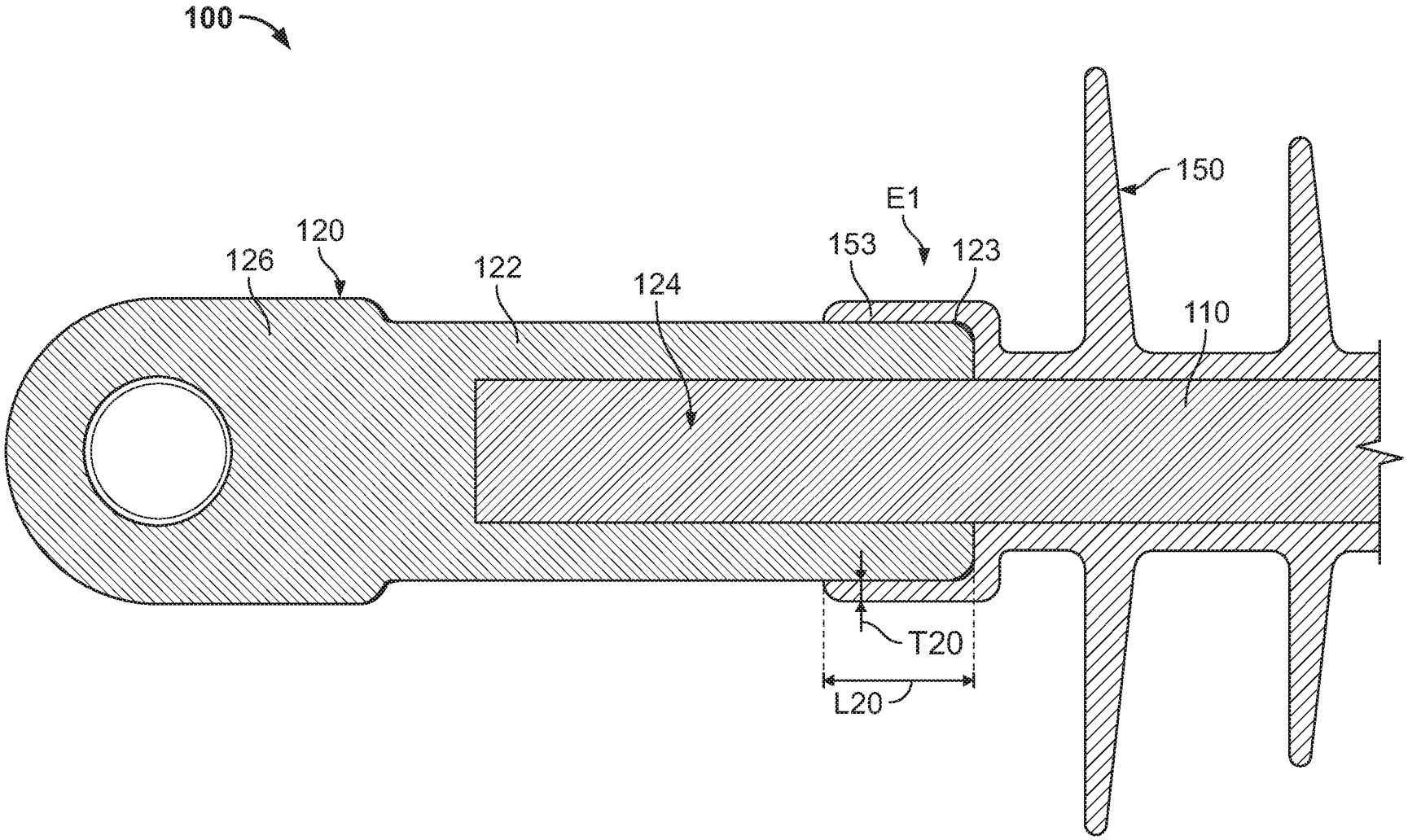
FIG. 7 is an enlarged, fragmentary, cross-sectional view of the insulator of FIG. 1 taken along the line 4-4 of FIG. 2.
Figure 8:
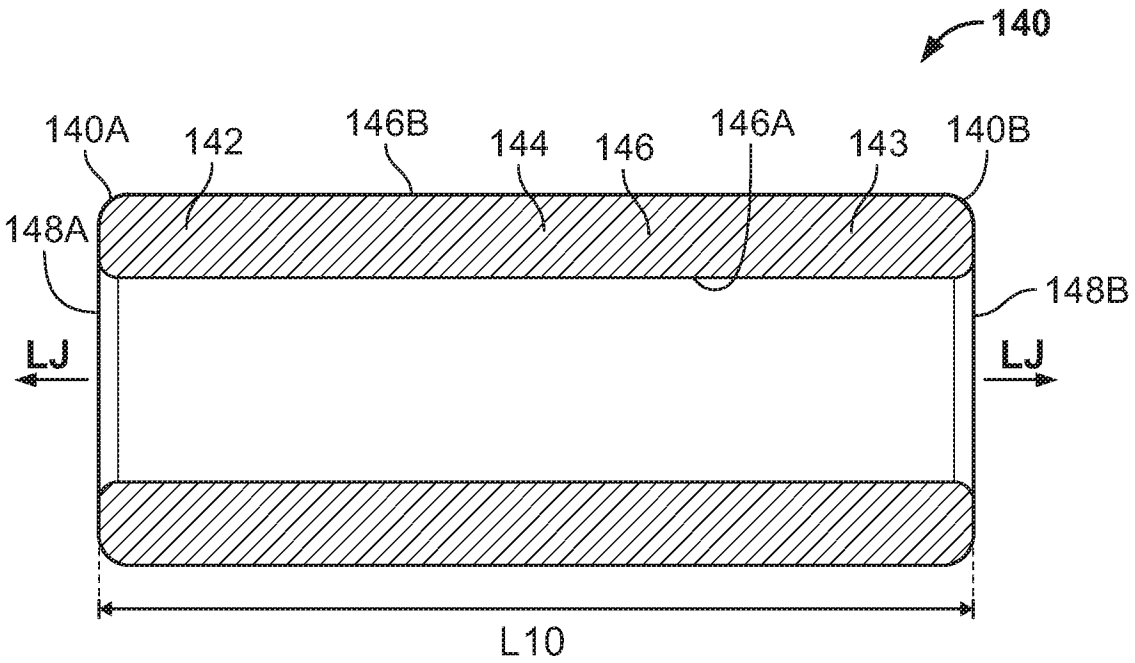
FIG. 8 is a cross-sectional view of a joint sleeve forming a part of the insulator of FIG. 1.
Figure 9:
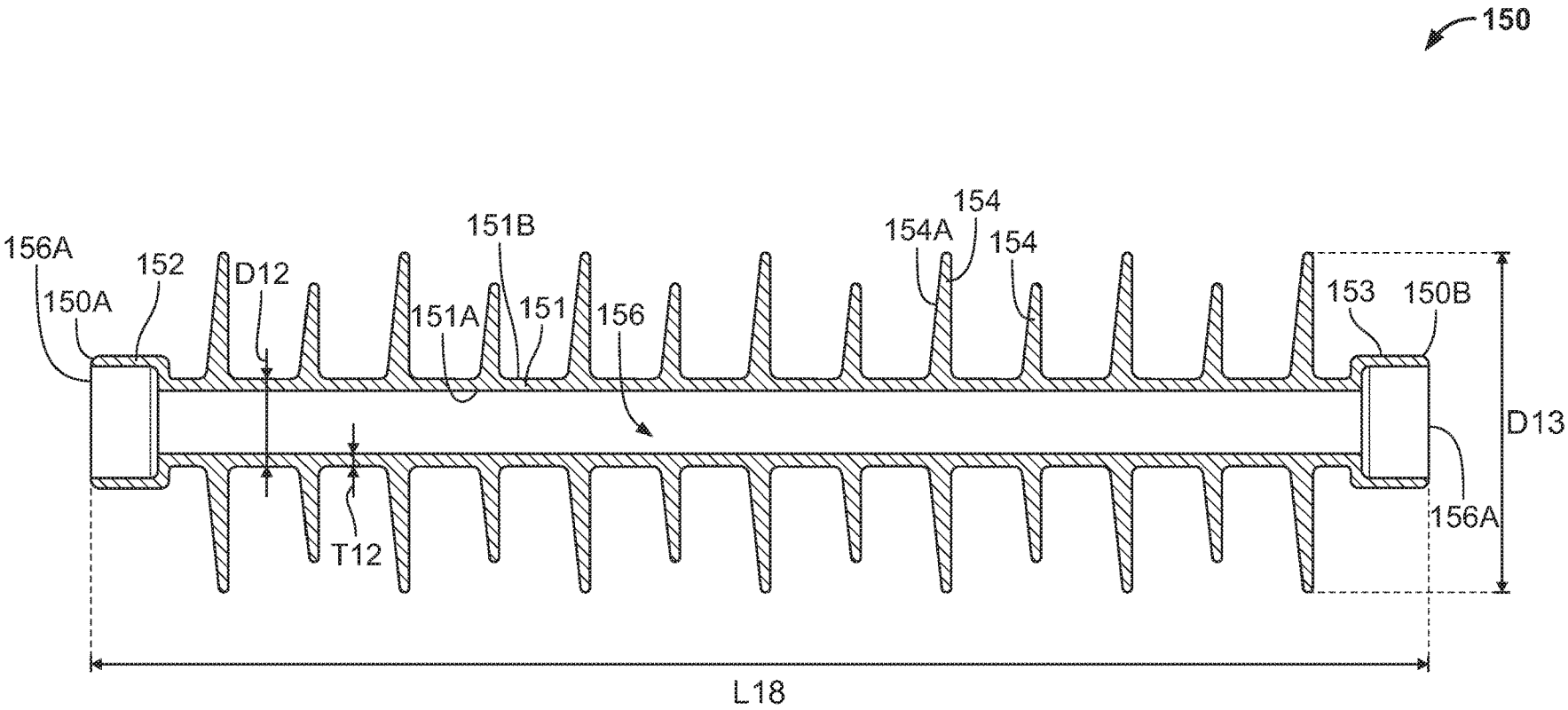
FIG. 9 is a cross-sectional view of a housing forming a part of the insulator of FIG. 1.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this disclosure and the relevant art and will not be interpreted in an idealized or overly formal sense unless expressly so defined herein.

As used herein, "monolithic" means an object that is a single, unitary piece formed or composed of a material without joints or seams.

With reference to FIGS. 1-9, a composite polymer insulator 100 according to embodiments of the invention is shown therein. The insulator 100 can be used to mechanically separate and electrically isolate first and second components. Typically, one of the components is an electrical power transmission conductor and the other component is an electrical power transmission conductor or a support structure.

Generally, the insulator 100 has an insulator lengthwise axis L-L and axially opposed ends 102A, 102B. The insulator 100 includes an insulator subassembly 103 and a pair of end fittings 120, 130. The end fittings 120, 130 are mounted on opposed ends of the insulator subassembly 103. Each end fitting 120, 130 includes a respective connector portion or coupling 126.

In some embodiments, the insulator 100 forms a part of an electrical power distribution system 10, such as a utility electrical power distribution system, for example. The illustrated electrical power distribution system 10 includes a support structure 20, a conductor clamp 25, and an electrical power transmission line or conductor 12. The support structure 20 may be a utility pole or other ground supported structure that suspends the conductor 12 above the ground as an aerial (overhead) electrical line, for example. The support structure 20 includes a base 22 and a coupling device or bracket 24. The conductor 12 is elongate and extends away from the support structure 20. In some embodiments, the conductor 12 is a high voltage power line (i.e., operating at a voltage of 69 kV or greater).

In the illustrated system 10, the insulator 100 is a tension or suspension insulator mounted between the support structure 20 and the conductor 12. The bracket 24 is affixed to the base 22. The insulator 100 is secured to the bracket 24 by the coupling 126 of the fitting 120. The insulator 100 is secured to the clamp 25 by the coupling 126 of the fitting 130. The clamp 25 is mounted on the conductor 12. The insulator 100 mechanically holds the conductor 12 apart from the bracket 24 and spans the distance between the conductor 12 and the bracket 24. In this manner, the insulator 100 mechanically spaces and electrically isolates the conductor 12 from the support structure 20.

It will be appreciated that the insulator 100 may be used in any application or electrical power distribution system in which composite polymeric insulators of this type may be used. The support structure may take other forms, the electrical power distribution system 10 may have a different configuration than shown and described herein, and the configuration of the insulator 100 may be modified to accommodate other applications. For example, the insulator 100 may instead be incorporated into the system 10 as a standoff insulator between the conductor 12 and the bracket 24. In other embodiments, the insulator 100 may be secured by the couplings 126 to and between two elongate conductors (e.g., electrical power lines) such that the insulator 100 spans the distance between the conductors and mechanically spaces and electrically isolates the conductors from one another. It will be appreciated that the couplings 126 may each be replaced with couplings suitably configured for the intended installation.

Turning to the insulator 100 in more detail, the insulator subassembly 103 includes a core 110, a joint fitting or sleeve 140, a first or upper housing 150, and a second or lower housing 160.

The core 110 has a longitudinal axis LC-LC coaxial with the axis L-L. The core 110 extends from a first or upper end 110A to an opposing second or lower end 110B.

The core 110 includes a first or upper end section 117A at the end 110A, and a second or lower end section 117B at the end 110B. The core 110 further includes a midsection 114, an upper main section 115 extending from the midsection 114 to the upper end section 117A, and a lower main section 116 extending from the midsection 114 to the lower end section 117B. The core 110 has an outer surface 118 extending along each of the sections 114, 115, 116, 117A, 117B. In some embodiments, the core 110 is cylindrical.

The core 110 can be formed of any suitable dielectric or electrically insulating material. In some embodiments, the core 110 is formed of a rigid material. In some embodiments, the core 110 is formed of a material having a dielectric strength of at least 140 volts/mil.

In some embodiments, the core 110 is formed of a fiber reinforced composite. In some embodiments, the core 110 is formed of a fiber reinforced polymer or plastic (FRP). In some embodiments, the core 110 is formed of a glass fiber reinforced polymer or plastic (GFRP) wherein the reinforcement fibers are glass fibers. In some embodiments, the polymer matrix includes plastic (e.g., vinyl or polyester) or resin.

In some embodiments, the core 110 is unitary. In some embodiments, the core 110 is monolithic.

The end fitting 120 (FIG. 7) is affixed to the upper end section 112. The end fitting 130 is affixed to the lower end section 113. Only the end fitting 120 will be described in detail hereinbelow. However, it will be appreciated that this description likewise applies to the other end fitting 130.

The end fitting 120 includes a body 122 having an inner end 123. A socket 124 is defined in the body 122 and opens toward the inner end 123. A coupling 126 is located (e.g., formed or mounted) on the outer end of the body 122.

The core upper end section 112 is received in the socket 124 of the end fitting 120. The core lower end section 113 is received in the socket 124 of the end fitting 130.

The end fittings 120, 130 can be formed of any suitable material. According to some embodiments, the end fittings 120, 130 are formed of metal. In some embodiments, the end fittings 120, 130 are formed of metal selected from the group consisting of steel, cast or ductile iron, aluminum, and stainless steel.

The illustrated end fittings 120, 130 are each tongue-tongue-type fittings. However, any suitable types or configurations of end fittings may be used. Other suitable types of end fittings may include ball, socket, or clevis type fittings, for example.

The joint sleeve 140 is mounted on the midsection 114 of the core 110. In some embodiments, the position (axial and rotational) of the joint sleeve 140 relative to the core 110 is fixed. In some embodiments, the joint sleeve 140 is affixed to the core 110. In some embodiments, the joint sleeve 140 is affixed to the core 110 by mechanically fitting or compressing the joint sleeve 140 onto the core 110. In some embodiments, the joint sleeve 140 is crimped onto the core 110.

The joint sleeve 140 (FIG. 8) has a longitudinal axis LJ-LJ coaxial with the axis L-L. The joint sleeve 140 extends from a first or upper end 140A to an opposing second or lower end 140B. The joint sleeve 140 includes a tubular sidewall 146 having an inner surface 146A and an outer surface 146B. The inner surface 146A defines an axially extending through passage 148 that terminates at opposed axial end openings 148A. In some embodiments, the outer surface 146B is substantially cylindrical.

In some embodiments, the joint sleeve 140 has a length L10 (FIG. 8) in the range of from about 75 to 250 mm.

The joint sleeve 140 can be formed of any suitable material. According to some embodiments, the joint sleeve 140 is formed of metal. In some embodiments, the joint sleeve 140 is formed of aluminum or aluminum alloy. In some embodiments, the joint sleeve 140 is formed of metal selected from the group consisting of steel, ductile iron, aluminum or stainless steel.

As discussed below, the joint sleeve 144 has a midsection 144 and opposed end sections 142 and 143. In some embodiments, the joint sleeve 140 does not have any openings to the through passage 148 in the midsection 144. In some embodiments, the joint sleeve 140 does not have any openings to the through passage 148 other than the end openings 148A. In some embodiments, the joint sleeve 140 is unitary. In some embodiments, the joint sleeve 140 is monolithic.

The housing 150 circumferentially surrounds the core upper main section 115 and adjacent portions of the end fitting 120 and the joint sleeve 140. The housing 160 circumferentially surrounds the core lower main section 116 and adjacent portions of the end fitting 130 and the joint sleeve 140. Only the upper housing 150 will be described in detail hereinbelow. However, it will be appreciated that this description likewise applies to the other housing 160.

The upper housing 150 (FIG. 9) includes a body 151 having a first or upper end 150A and an opposing second or lower end 150B. The body 151 is tubular and has an inner surface 151A and an outer surface 151B. The inner surface 151A defines an axially extending through passage 156 that terminates at opposed axial end openings 156A. In some embodiments, the outer surface 151B is substantially cylindrical.

A series of axially spaced apart, annular sheds or skirts 154 project radially outwardly from the outer surface 151B. In some embodiments, the sheds 154 are directional. For example, in some embodiments, the upper side 154A of each shed 154 is sloped downwardly from the body 151 to the outer edge of the shed 154.

The housing 150 further includes an upper end section or joint section 152 and a lower end section or joint section 153. As discussed below, the joint section 152 overlaps the end fitting 120 at a joint E1, and the joint section 153 overlaps the joint sleeve 140 at a joint J1.

The housing 150 can be formed of any suitable dielectric or electrically insulating polymeric material. According to some embodiments, the housing 150 is formed of an elastomeric material. According to some embodiments, the housing 150 is formed of silicone rubber, EVA, EPDM, or other suitable rubber or other polymeric material.

In some embodiments, the housing 150 is formed of a material having a dielectric strength of at least 15 kV/mm.

In some embodiments, the housing 150 is monolithic.

In some embodiments, the housing body 151 has an outer diameter D12 (FIG. 9) in the range of from about 22 mm to 85 mm. In some embodiments, the outer diameter D12 of the housing body 151 is substantially uniform from the joint section 152 to the joint section 153.

In some embodiments, the housing 150 has a total length L18 (FIG. 9) in the range of from about 500 mm to 2000 mm.

In some embodiments, the housing body 151 has a thickness T12 (FIG. 9) in the range of from about 2 mm to 5 mm.

In some embodiments, each shed 154 has an outer diameter D13 (FIG. 9) in the range of from about 55 mm to 200 mm.

The housing 160 likewise includes a housing body 161, sheds 164, an upper end section or joint section 162 and a lower end section or joint section 163. As discussed below, the joint section 162 overlaps the joint sleeve 140 at a joint J2, and the joint section 163 overlaps the end fitting 130 at a joint E2.

In some embodiments, a midsection 144 of the joint sleeve 140 is exposed and is not covered by either of the housings 150, 160. Instead, the metal midsection 144 is exposed to the environment.

In some embodiments, each housing joint section 152, 163 axially overlaps the corresponding end fitting 120, 130 at its joint J1, J2 by a length L20 (FIG. 7) in the range of from about 10 mm to 100 mm.

In some embodiments, each housing joint section 152, 163 has a thickness T20 (FIG. 7) in the range of from about 3 mm to 15 mm.

In some embodiments, each housing joint section 153, 162 axially overlaps the corresponding joint sleeve end section 142, 143 at its joint J1, J2 by a length L21 (FIG. 6) in the range of from about 10 mm to 100 mm.

In some embodiments, each housing joint section 153, 162 has a thickness T21 (FIG. 6) in the range of from about 3 mm to 15 mm.

In some embodiments, the exposed midsection 144 of the joint sleeve 140 has a length L22 (FIG. 6) in the range of from about 25 mm to 150 mm.

The insulator 100 may be manufactured using steps and apparatus as described below in accordance with some embodiments.

Figure 10:
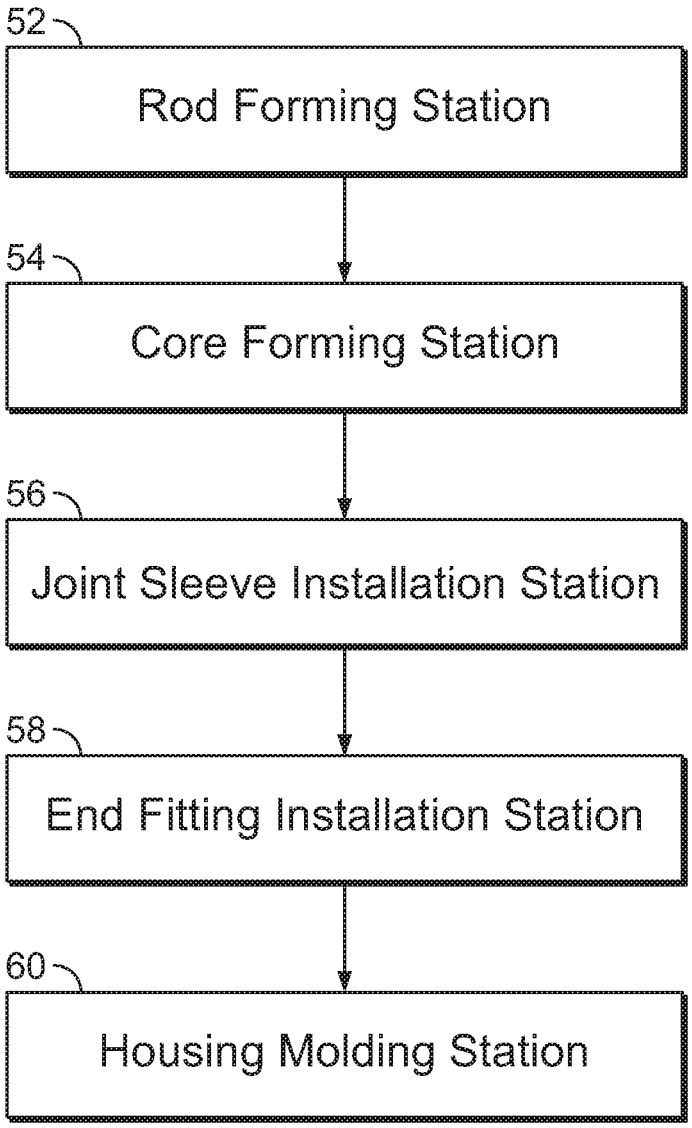
FIG. 10 is a schematic diagram of an insulator manufacturing system according to some embodiments for forming the insulator of FIG. 1.

The insulator 100 may be assembled using an insulator manufacturing apparatus or system 50, which is schematically represented in FIG. 10. The system 50 includes a rod forming station 52, a core forming station 54, a joint sleeve installation station 56, an end fitting installation station 58, and a housing molding station 60. The system 50 may be configured to perform some or all of the manufacturing steps described below continuously or in discrete steps. The stations may all be located at the same manufacturing facility, or some of the stations may be located at different facilities from one another.

Figure 11:
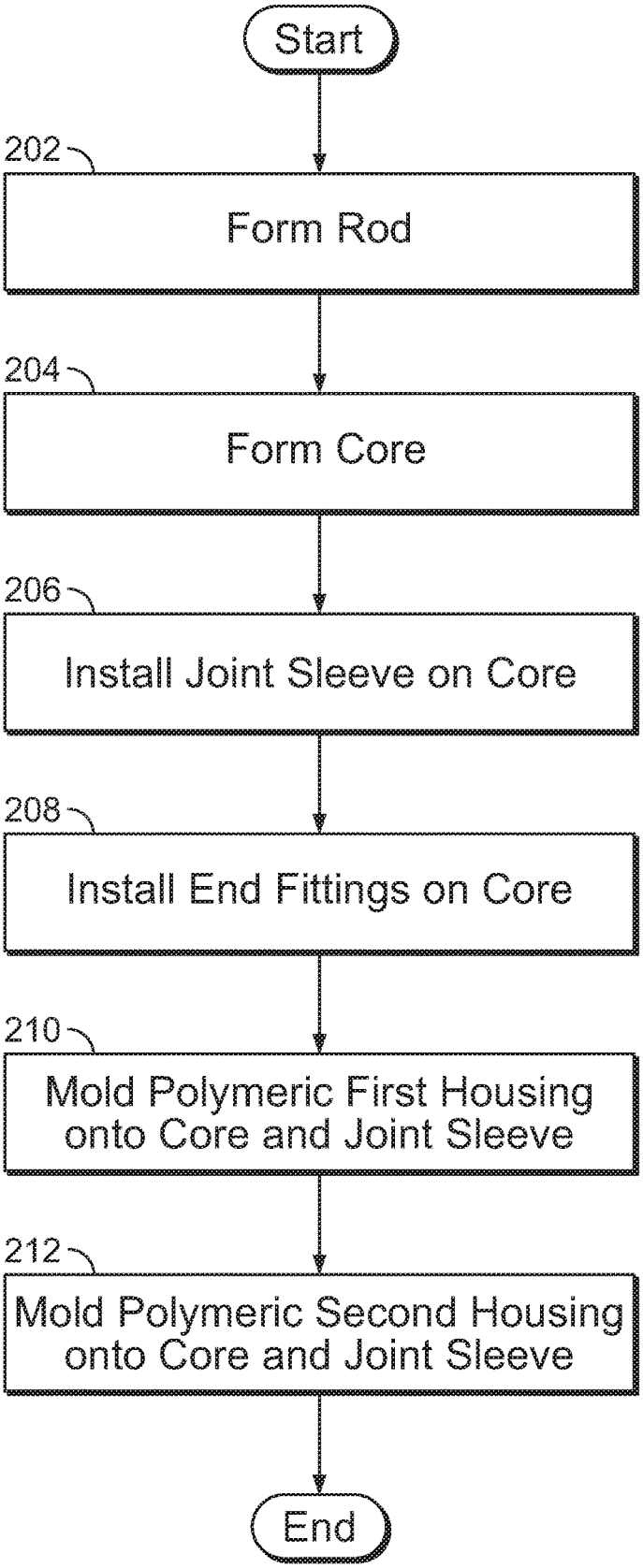
FIG. 11 is a flowchart representing methods according to some embodiments for forming the insulator of FIG. 1.

With reference to the flow chart of FIG. 11, a rod is formed by or using the rod forming station 52 (Block 202). The rod is an elongate stock of the material used to form the core 110. The rod may be formed using any suitable manufacturing technique. In some embodiments, the rod is formed by extrusion or pultrusion. In some embodiments, the rod is formed by extruding or pultruding FRP.

Cores 110 are then formed from the rod by or using the core forming station 54 (Block 204). For example, in some embodiments the core forming station 54 is used to cut sections from the rod, each rod section corresponding to a respective core 110.

In other embodiments, the core or cores 110 may be individually formed (e.g., cast, extruded, or machined) rather than multiple cores being cut from a single nod.

Each severed rod section may be handled or treated as desired to form the finished core 110. For example, the cut rod section may be trimmed to a specified length and/or the surface of the cut rod may be treated to promote uniformity or adhesion with the housings 150, 160. In some embodiments, the outer surfaces of the core sections 115, 116 are coated with a primer to promote subsequent bonding between the core 110 and the housings 150, 160.

Each core 110 is transferred to the joint sleeve installation station 56. The joint sleeve installation station 56 installs or is used to install the joint sleeve 140 on the midsection 114 of the core 110 (Block 206).

In some embodiments, the joint sleeve 140 is a preformed tubular member having an inner diameter the same as or greater than the outer diameter of the core 110. This joint sleeve 140 is slid onto the core 110 to the midsection 114, and then affixed in place on the midsection 114.

In other embodiments, the joint sleeve 140 may be a nontubular member that is formed about the core 110 into a tubular member.

The joint sleeve 140 may be secured around the midsection 140 using any suitable technique. For example, the joint sleeve 140 may be affixed to the midsection 140 by interference fit and/or bonding (using an adhesive or heat bonding).

In some embodiments, the joint sleeve installation station 56 includes a crimping device that crimps the joint sleeve 140 onto the midsection 114 to thereby mechanically affix the joint sleeve 140 to midsection 114. In some embodiments, the crimping device deforms (crimps) the joint sleeve 140 to have an inner diameter that is less than the initial outer diameter of the midsection 114 so that the inner surface 146A of the joint sleeve 140 forms a secure interference and/or interlocking fit with the outer surface 118 of the core 110.

In some embodiments, a moisture barrier sealant is applied between the joint sleeve 140 and the core 110.

Each core 110 is transferred to the end fitting installation station 58. The end fitting installation station 58 installs or is used to install the end fittings 120, 130 on the end sections 112, 113 of the core 110 (Block 208). More particularly, the end sections 112, 113 are inserted into the sockets 124 of the end fittings 120, 130 and affixed therein.

The end sections 112, 113 may be secured in the sockets 124 using any suitable technique. For example, the end sections 112, 113 may be affixed in the sockets 124 by interference fit and/or bonding (using an adhesive or heat bonding). In some embodiments, the end fitting installation station 58 includes a crimping device that crimps the end fittings 120, 130 onto the end sections 112, 113 to thereby mechanically affix the end fittings 120, 130 to the core 110.

In some embodiments, a moisture barrier sealant is applied between the end sections 112, 113 and the end fittings 120, 130 (e.g., in the sockets 124 or at the openings of the sockets 124).

The order of the steps of installing the end fittings 120, 130 and the joint sleeve 140 may be varied.

The subassembly including the end fittings 120, 130 and the joint sleeve 140 mounted on the core 110 is transferred to the housing molding station 60. The housing molding station 60 includes a molding apparatus. The housing molding station 60 is used to mold the upper housing 150 directly onto the core 110, the end fitting 120, and the joint sleeve 140 (Block 210). More particularly, the housing molding station 60 molds the body 151 onto the core upper main section 115, molds the housing upper joint section 152 onto an end section 128 of the end fitting 120, and molds the housing lower joint section 153 onto the upper section 142 of the joint sleeve 140. The molding step thereby forms the polymer-to-metal joints E1 and J1. In some embodiments, the sheds 154 are also formed by the molding step.

The housing molding station 60 may mold the upper housing 150 using any suitable technique. In some embodiments, a suitably configured mold is placed about the core section 115 and the upper housing 150 is injection molded, insert molded or overmolded onto the upper core section 115. For example, a mold may be installed around the core section 115, the mold defining a cavity in the shape of the housing 150. Liquid mold material (e.g., molten silicone rubber) is forcibly injected into the mold cavity and then permitted to cure into the solid housing 150. Techniques, processes and apparatus for molding polymeric insulator housings are known and therefore will not be described herein in detail.

The housing molding station 60 (or another housing molding station) is also used to mold the lower housing 160 directly onto the section 116, the end section 128 of the end fitting 130, and the end section 143 of the joint sleeve 140 (Block 212). The molding apparatus and process may be the same as described for the molding of the upper housing 150. This molding step thereby forms the polymer-to-metal joints E2 and J2.

In some embodiments, the upper housing 150 and the lower housing 160 are molded sequentially. For example, the upper housing 150 may be molded, and the lower housing 160 thereafter molded.

In some embodiments, the upper housing 150 and the lower housing 160 are molded using the same mold. For example, the upper housing 150 may be molded using a mold. The subassembly is then removed from the mold and repositioned to place the lower main section 116 in the mold. The lower housing 160 is then molded onto the lower main section 116 using the mold.

In some embodiments, repositioning the subassembly includes reorienting the core 110 relative to the mold such that the lower housing 160 is properly oriented relative to the housing 150 and the end fittings. For example, if the housings 150, 160 are axially asymmetric, the subassembly is reoriented to ensure that the symmetries of the housings 150, 160 are consistent. In particular, if the sheds 154, 164 are directional in their slopes, the subassembly is reoriented to ensure that the slopes of the sheds 154, 164 are in the same direction.

In some embodiments, the outer surfaces of the end fitting sections 128 and/or the outer surfaces of the joint sleeve sections 142, 143 are coated with a primer (prior to molding the housings 150, 160 over the core 110) to promote bonding with the housings 150, 160.

In some embodiments, the outer surfaces of the end fitting sections 128 and/or the outer surfaces of the joint sleeve sections 142, 143 are coated with an adhesive (prior to molding the housings 150, 160 over the core 110) to promote bonding with the housings 150, 160.

The process of molding the housings 150, 160 onto the joint sleeve 140 causes the inner surfaces of the end sections 153, 162 of the housings 150, 160 to bond to the outer surfaces of the end sections 142, 143 of the joint sleeve 140. In some embodiments, the bonds between the housing sections 153, 162 and the joint sleeve sections 142, 143 are substantially water proof.

In some embodiments, the bonds between the material of the housings 150, 160 (e.g., silicone rubber) and the material of the joint sleeve 140 (e.g., aluminum) are direct bonds.

In some embodiments, the joint sleeve sections 142, 143 are coated with a primer before the overmolding step and the primer enhances the bonds between the housing sections 153, 162 and the joint sleeve sections 142, 143.

In some embodiments, the joint sleeve sections 142, 143 are coated with a layer of an adhesive before the overmolding step and the adhesive enhances the bonds between the housing sections 153, 162 and the joint sleeve sections 142, 143.

In some embodiments, the molding steps bond the inner diameters of the housings 150, 160 to the outer surfaces of the core main sections 115, 116. In some embodiments the bonds between the material of the housings 150, 160 (e.g., silicone rubber) and the material of the core 110 (e.g., FRP) are direct bonds.

In some embodiments, the core main sections 115, 116 are coated with a primer before the overmolding steps and the primer enhances the bonds between the housings 150, 160 and the core main sections 115, 116.

In some embodiments, the core main sections 115, 116 are coated with a layer of an adhesive before the overmolding steps and the adhesive enhances the bonds between the housings 150, 160 and the core main sections 115, 116.

In use, the insulator 100 is mounted on the supporting components 20, 12 using the couplings 126, for example. More particularly, the coupling 126 of the end fitting 120 is affixed directly to the bracket 24 by a bolt, for example. The coupling 126 of the end fitting 130 is affixed directly to the clamp 25 by a bolt, for example. It will be appreciated that other types of couplings and coupling techniques can be used instead.

The core 110 provides mechanical strength to the insulator 100. In some embodiments, the core 110 is stronger and stiffer than the housings 150, 160. In some embodiments, the housings 150, 160 would be flexible if not supported by the core 110.

Insulators (e.g., the insulator 100) according to embodiments of the invention, and methods and apparatus for forming the same, can provide important advantages over conventional methods for manufacturing long polymer insulators. Current manufacturing techniques for producing long composite polymer insulators typically require molds that are bulky and expensive. The handling equipment required for bulky molds may be expensive.

Alternatively, current manufacturing techniques may include molding insulator housings in multiple sections on a core during the molding process. The sections have overlapping polymer surfaces that are bonded to form polymer-to-polymer joints. These polymer-to-polymer joints are susceptible to damage due to electrical activity and tears.

Insulators according to embodiments of the invention can overcome these problems. Because the housings 150, 160 are individually molded, it is not necessary to employ bulky molds. This enables the manufacturer to produce long composite polymer insulators with smaller footprint molding machines and molds.

The joint sleeve 140 eliminates the need for polymer-to-polymer joints between housing sections. The polymer-to-metal bonded joints J1, J2 are significantly stronger and more durable in service than polymer-to-polymer joints.

According to particular embodiments, the core 110 is formed of FRP, the joint sleeve 140 is formed of aluminum, and the housings 150, 160 are formed of a suitable electrically insulating polymer. In some particular embodiments, the core 110 is formed of FRP, the joint sleeve 140 is formed of aluminum, and the housings 150, 160 are formed of silicone rubber.

According to further embodiments, the insulator 100 is modified to include two or more metal joint sleeves 140 affixed (e.g., crimped onto) the core 110, and three or more polymer housings 150, 160 extending axially between and overlapping the joint sleeves 140 to form metal-to-polymer joints as described above. For example, the modified insulator 100 may include (in serial arrangement on the single core 110) the end fitting 120, the housing 150, the joint sleeve 140, a further housing, a further joint sleeve, the housing 160, and the end fitting 130.

In some embodiments, the insulator 100 has an overall length L1 (FIG. 4) of at least 500 mm and, in some embodiments, in the range of from about 500 mm to 6000 mm.

In some embodiments, the insulator 100 has a dry arc distance LE (FIG. 4) extending from the end 150A of the housing 150 to the end 160B of the housing 160. In some embodiments, the dry arc distance LE is at least 350 mm and, in some embodiments, is in the range of from about 350 mm to 5500 mm.

In some embodiments, the insulator 100 has a minimum lightning impulse withstand voltage (LIWV) of at least 500 kV.

Figure 12:
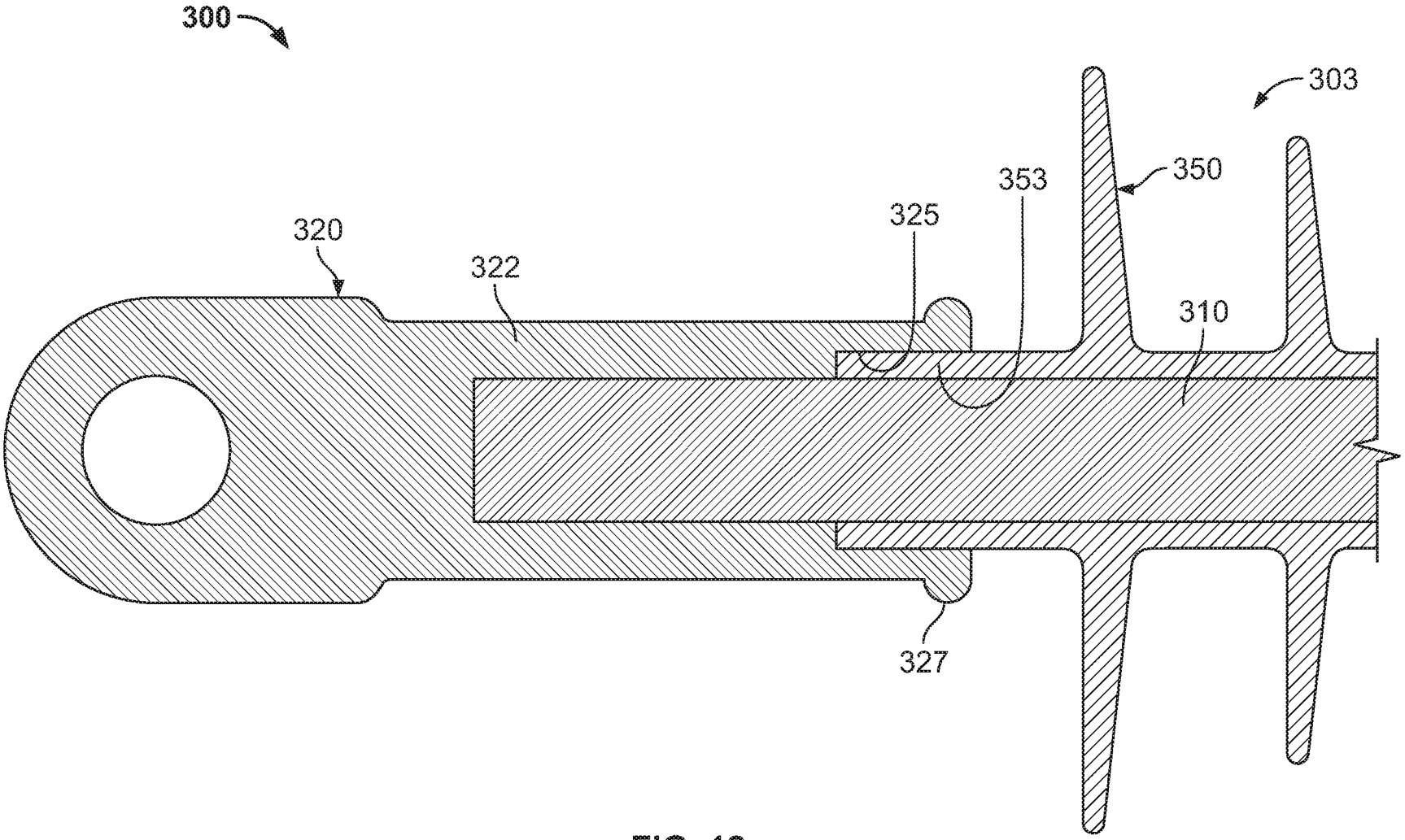
FIG. 12 is a fragmentary, cross-sectional view of a composite polymer insulator according to further embodiments.

With reference to FIG. 12, a composite polymer insulator 300 according to further embodiments is shown therein. The insulator 300 may be constructed, manufactured, and used in the same manner as the insulator 100, except as discussed below.

The insulator 300 includes an insulator subassembly 303 and a pair of opposed end fittings 320 (only one shown in FIG. 12). The subassembly 303 is constructed in the same manner as the subassembly 103 except at its ends. The subassembly 303 includes a core 310, a joint sleeve (not shown), and upper housing 350, and a lower housing (not shown) corresponding to the core 110, a joint sleeve 140, and upper housing 150, and a lower housing 160 of the subassembly 103. FIG. 12 shows one end of the insulator 100, and the opposing end may be a duplicate or mirror image thereof.

The insulator 300 differs from the insulator 100 in that the outer end of each housing 350 does not overlap the adjacent end fitting 320. Instead, a joint section 353 of the housing 350 is inserted within an inner end of the body 322 of the end fitting 320. In some embodiments, the end fitting 320 includes a groove or chamfer 325 to receive the housing joint section 353. The end fitting 320 may include an integral corona suppression ring at or adjacent the inner end of the end fitting 320.

According to some embodiments, the insulator 300 is manufactured in the same manner as described for the insulator 100 except that each housing 350 is molded onto the core and joint sleeve (FIG. 11, Blocks 210 and 212) prior to the step of installing the associated end fitting 320 onto the core 310 (FIG. 11, Block 208). Each end fitting 320 is slid over the associated joint section 353.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A method for manufacturing a composite polymer insulator, the method comprising:

providing an elongate core having a core axis, the core including a first core main section, a second core main section, and a core midsection axially interposed between the first and second core main sections;

mounting a joint sleeve formed of metal around the core midsection, the joint sleeve including a midsection and first and second end sections extending from opposed ends of the midsection;

molding a polymeric first housing onto the core such that:

the first housing surrounds the first core main section; and a joint section of the first housing overlaps and bonds to the first end section of the joint sleeve; and molding a polymeric second housing onto the core such that:

the second housing surrounds the second core main section;

a joint section of the second housing overlaps and bonds to the second end section of the joint sleeve; and the second housing is a discrete and separate component from the first housing, wherein the midsection of the joint sleeve is located between the first and second housings and is not covered by either of the first and second housings.

2. The method of claim 1 wherein mounting the joint sleeve around the core midsection includes crimping the joint sleeve onto the core midsection.

3. The method of claim 2 wherein the core is formed of fiber reinforced polymer (FRP).

4. The method of claim 3 wherein the core is formed of glass fiber reinforced polymer (GFRP).

5. The method of claim 3 wherein the first and second housings are formed of silicone rubber.

6. The method of claim 1 wherein the core is formed of fiber reinforced polymer (FRP).

7. The method of claim 1 wherein the first and second housings are formed of an elastomer.

8. The method of claim 1 wherein:

the core has first and second opposed ends; and the method includes:

affixing a first end fitting to the first end of the core, the first end fitting including a first coupling configured to secure the composite polymer insulator to an electrical conductor or support; and affixing a second end fitting to the second end of the core, the second end fitting including a second coupling configured to secure the composite polymer insulator to another electrical conductor or support.

9. The method of claim 8 wherein:

molding the first housing onto the core includes molding the first housing onto the core such that a second joint section of the first housing overlaps and bonds to the first end fitting; and molding the second housing onto the core includes molding the second housing onto the core such that a second joint section of the second housing overlaps and bonds to the second end fitting.

10. The method of claim 9 wherein:

affixing the first end fitting to the first end of the core includes crimping the first end fitting onto the first end of the core; and affixing the second end fitting to the second end of the core includes crimping the second end fitting onto the second end of the core.

11. The method of claim 1 wherein molding the first housing onto the core includes molding the first housing onto the core such that the first housing includes a tubular body and integral annular sheds extending radially outward from the body; and molding the second housing onto the core includes molding the second housing onto the core such that the second housing includes a tubular body and integral annular sheds extending radially outward from the body.

12. The method of claim 11 wherein the sheds of the first and second housings are sloped in the same axial direction.

13. The method of claim 1 wherein:

molding the first housing onto the core includes injection molding the first housing onto the first core main section and the joint sleeve; and molding the second housing onto the core includes injection molding the second housing onto the second core main section and the joint sleeve.

14. The method of claim 1 wherein the uncovered midsection of the joint sleeve extends circumferentially around the joint sleeve between the first and second housings.

15. The method of claim 14, wherein the circumferentially extending uncovered midsection is exposed to environmental conditions.

16. The method of claim 1 wherein the uncovered midsection of the joint sleeve has a length in the range of from 25 mm to 150 mm.

17. The method of claim 1, wherein the molding of the second polymeric housing onto the core step is executed after the molding of the first polymeric housing onto the core step.

18. A composite polymer insulator comprising:

an elongate core having a core axis, the core including a first core main section, a second core main section, and a core midsection axially interposed between the first and second core main sections;

a polymeric first housing surrounding the first core main section;

a polymeric second housing surrounding the second core main section;

a joint sleeve formed of metal surrounding the core midsection, the joint sleeve including a midsection and first and second end sections extending from opposed ends of the midsection;

wherein:

the first housing includes a joint section overlapping and bonded to the first end section of the joint sleeve;

the second housing includes a joint section overlapping and bonded to the second end section of the joint sleeve, and the midsection of the joint sleeve is located between the first and second housings and is not covered by either of the first and second housings.

19. The composite polymer insulator of claim 18 wherein the joint sleeve is formed of metal.

20. The composite polymer insulator of claim 19 wherein the joint sleeve is crimped onto the core midsection.

21. The composite polymer insulator of claim 20 wherein the core is formed of fiber reinforced polymer (FRP).

22. The composite polymer insulator of claim 21 wherein the first and second housings are formed of silicone rubber.

* * * * *